US012644639B2

(12) United States Patent
Parikshit et al.

(10) Patent No.: US 12,644,639 B2
(45) Date of Patent: Jun. 2, 2026

(54) BIN STORAGE SYSTEM FOR A REFRIGERATOR APPLIANCE

(71) Applicant: WHIRLPOOL CORPORATION, Benton Harbor, MI (US)

(72) Inventors: Gowardhan Parikshit, Pune (IN); Sunil Patil, Belagavi (IN); Ryan Post, Coloma, MI (US); Lalit Suryawanshi, Pune (IN)

(73) Assignee: Whirlpool Corporation, Benton Harbor, MI (US)

( * ) Notice: Subject to any disclaimer, the term of this patent is extended or adjusted under 35 U.S.C. 154(b) by 123 days.

(21) Appl. No.: 18/671,096

(22) Filed: May 22, 2024

(65) Prior Publication Data

US 2025/0362074 A1 Nov. 27, 2025

(51) Int. Cl.

| | |
|---|---|
| ***F25D 25/02*** | (2006.01) |
| ***F25D 23/02*** | (2006.01) |
| ***F25D 23/04*** | (2006.01) |
| ***F25D 23/06*** | (2006.01) |

(52) U.S. Cl.

CPC ..... *F25D 23/04* (2013.01); *F25D 23/067* (2013.01); *A47B 2210/0056* (2013.01); *A47B 2210/175* (2013.01); *F25D 25/025* (2013.01)

(58) Field of Classification Search

CPC ..... F25D 23/04; F25D 25/025; F25D 23/067; A47B 2210/17; A47B 2210/175; A47B 2210/0056

See application file for complete search history.

(56) References Cited

U.S. PATENT DOCUMENTS

| | | | | |
|---|---|---|---|---|
| 5,242,221 | A * | 9/1993 | Rotthowe | A47B 88/427 384/22 |
| 8,578,571 | B2 | 11/2013 | Schmidt et al. | |
| 9,816,746 | B1 * | 11/2017 | Haney | F25D 23/04 |
| 10,041,728 | B2 | 8/2018 | Go et al. | |
| 10,436,503 | B2 | 10/2019 | Rotter et al. | |
| 2008/0203875 | A1 * | 8/2008 | Lim | F25D 23/021 312/404 |
| 2010/0019641 | A1 * | 1/2010 | Laible | F25D 25/025 312/404 |
| 2018/0142943 | A1 * | 5/2018 | Haney | F25D 25/025 |
| 2019/0170428 | A1 * | 6/2019 | Haney | F25D 25/025 |

FOREIGN PATENT DOCUMENTS

| | | | | |
|---|---|---|---|---|
| CN | 108720379 | A * | 11/2018 | A47B 88/423 |
| CN | 208704285 | U * | 4/2019 | |
| JP | 2016214758 | A * | 12/2016 | |
| KR | 20190019452 | A * | 2/2019 | A47B 88/43 |
| WO | 2007062961 | A1 | 6/2007 | |

* cited by examiner

*Primary Examiner* — Kimberley S Wright

(74) *Attorney, Agent, or Firm* — Brooks Kushman P.C.

(57) ABSTRACT

A storage system for a refrigerator includes a drawer, a rail, a cap, and a clip. The drawer has a frame and a bin removably disposed on top of the frame. The rail is movably secured to the frame such that the drawer is operable to transition between deployed and stowed positions. The cap is disposed along an end of the rail and defines a recess extending laterally inward therefrom. The clip extends downward from the frame and comprises a laterally extending protrusion. The laterally extending protrusion extends into the recess and engages the cap within the recess to secure the frame to the rail and restrict lateral movement of the frame relative to the rail.

20 Claims, 6 Drawing Sheets

BIN STORAGE SYSTEM FOR A REFRIGERATOR APPLIANCE

TECHNICAL FIELD

The present disclosure relates to an appliance such as a refrigerator.

BACKGROUND

In order to keep food fresh, a low temperature must be maintained within a refrigerator to reduce the reproduction rate of harmful bacteria. Refrigerators circulate refrigerant and change the refrigerant from a liquid state to a gas state by an evaporation process in order cool the air within the refrigerator. During the evaporation process, heat is transferred to the refrigerant. After evaporating, a compressor increases the pressure, and in turn, the temperature of the refrigerant. The gas refrigerant is then condensed into a liquid and the excess heat is rejected to the ambient surroundings. The process then repeats.

SUMMARY

A refrigerator includes a cabinet, a door, a pull-out bin, rails, caps, and clips. The cabinet defines a least one refrigerated compartment. The door is movably secured to the cabinet. The pull-out bin is secured to an interior side of the door. The pull-out bin is configured to transition between retracted and advanced positions. The pull-out bin comprises a frame and a receptacle. The receptacle is removably disposed on top of the frame and is configured to receive items for storage therein. The rails are slidably secured to the interior side of the door and are disposed on opposing lateral sides of the pull-out bin. The pull-out bin is configured to transition between the retracted and advanced positions via the rails. The caps are disposed along ends of the rails. The caps define recesses extending laterally inward along sides of the caps. The clips extend downward from a bottom of the frame. The clips have protrusions extending laterally inward along sides of the clips. The protrusions extend into the recesses and engage the caps within the recesses to secure the frame to the rails and to restrict lateral movement of the frame in a direction extending between the rails.

A refrigerator includes a cabinet, a door, a drawer, a rail, a cap, and a clip. The cabinet defines a refrigerated compartment. The door is secured to the cabinet. The drawer is disposed on the door and is operable to receive items for storage therein. The rail movably secures the drawer to the door. The cap is disposed along an end of the rail and defines at least one recess extending laterally inward from an exterior of the cap. The clip extends downward from a bottom of drawer. The clip comprises at least one biasing element and at least one laterally extending protrusion extending from the at least one biasing element. The at least one laterally extending protrusion extends into the at least one recess and engages the cap within the at least one recess to secure the drawer to the rail and restrict movement of the drawer relative to the rail.

A storage system for a refrigerator includes a drawer, a rail, a cap, and a clip. The drawer has a frame and a bin removably disposed on top of the frame. The rail is movably secured to the frame such that the drawer is operable to transition between deployed and stowed positions. The cap is disposed along an end of the rail and defines a recess extending laterally inward therefrom. The clip extends downward from the frame and comprises a laterally extending protrusion. The laterally extending protrusion extends into the recess and engages the cap within the recess to secure the frame to the rail and restrict lateral movement of the frame relative to the rail.

DETAILED DESCRIPTION

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
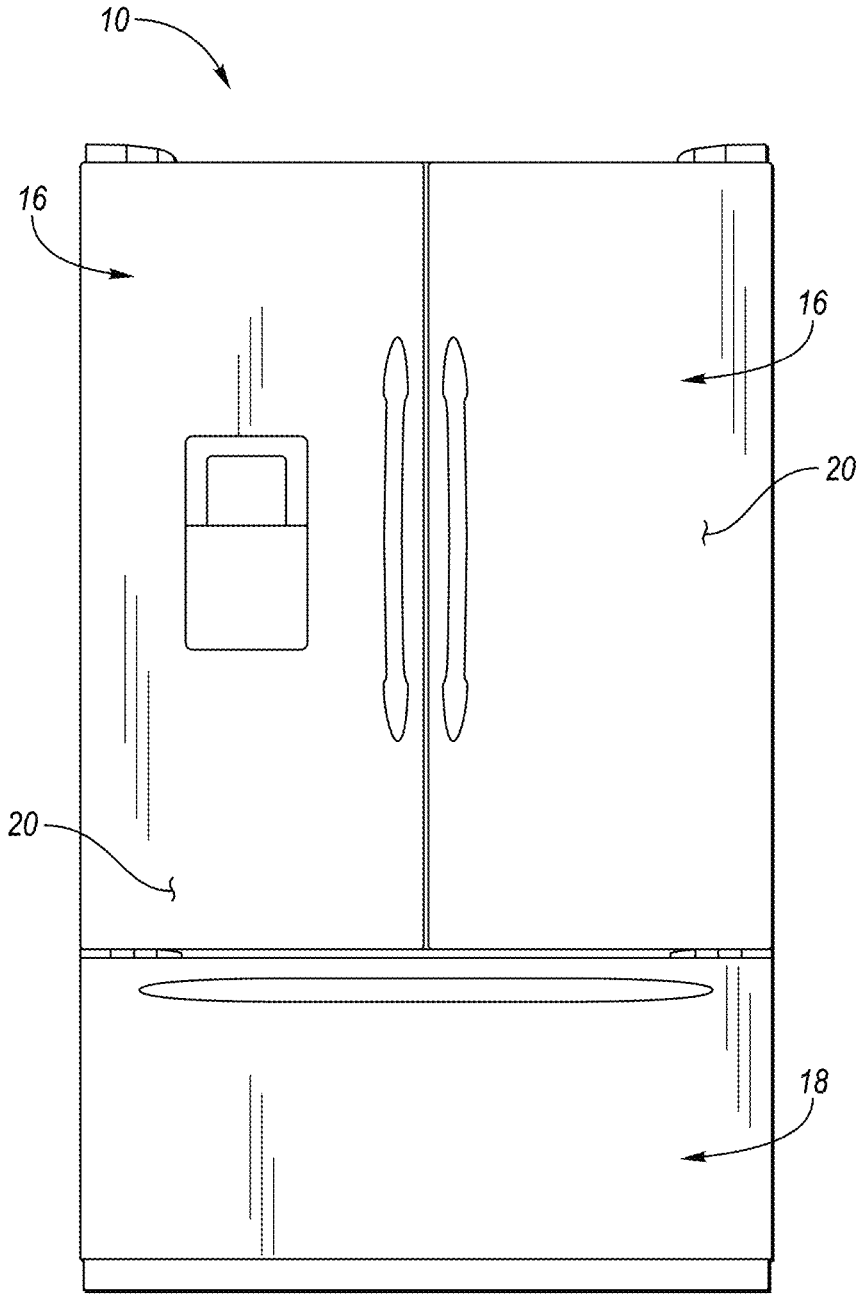
FIG. 1 is an elevated front view of a French-Door Bottom Mount type refrigerator appliance.
Figure 2:
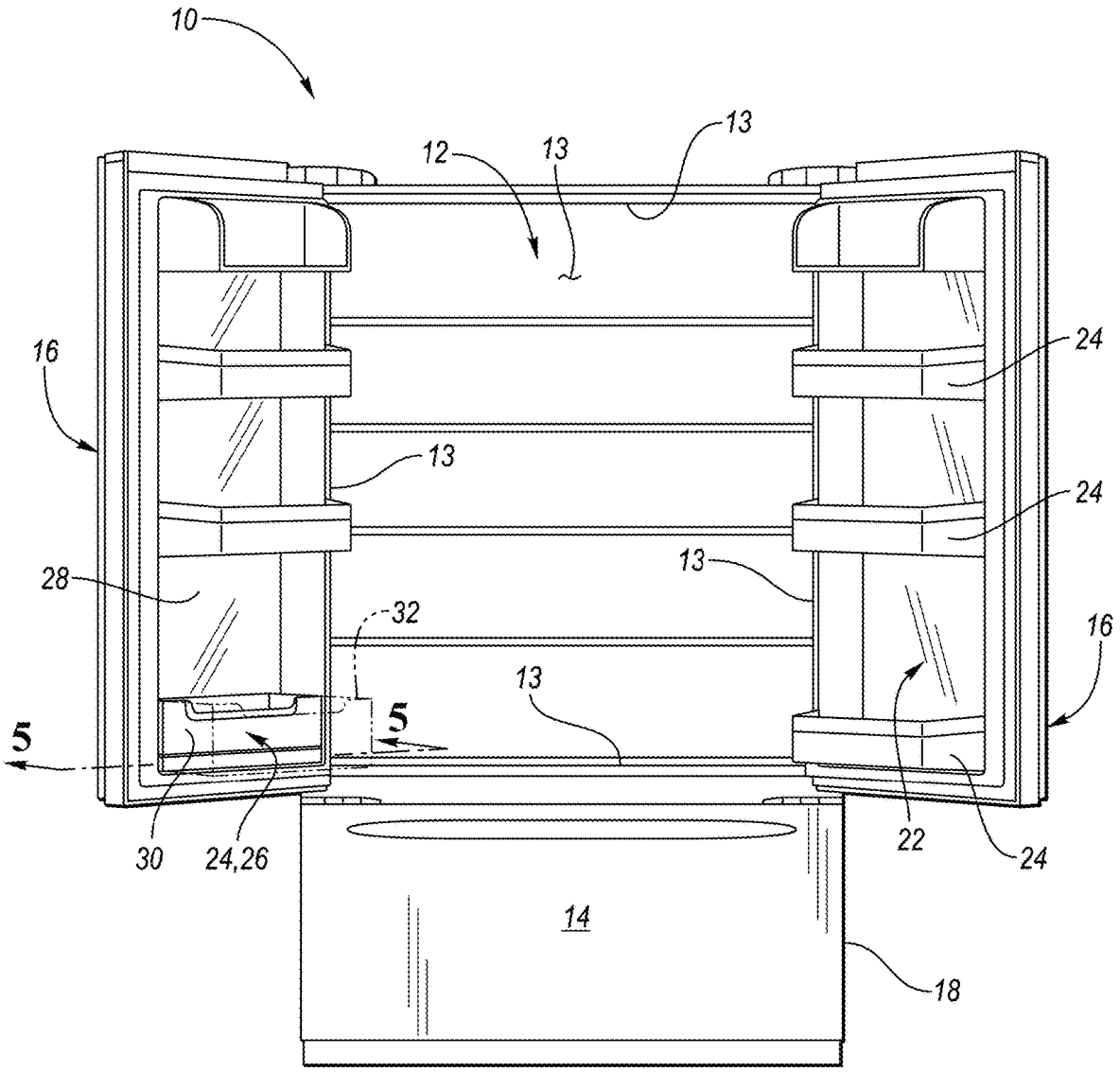
FIG. 2 is an elevated front view of a French-Door Bottom Mount type refrigerator with the refrigerator compartment doors open.
Figure 3:
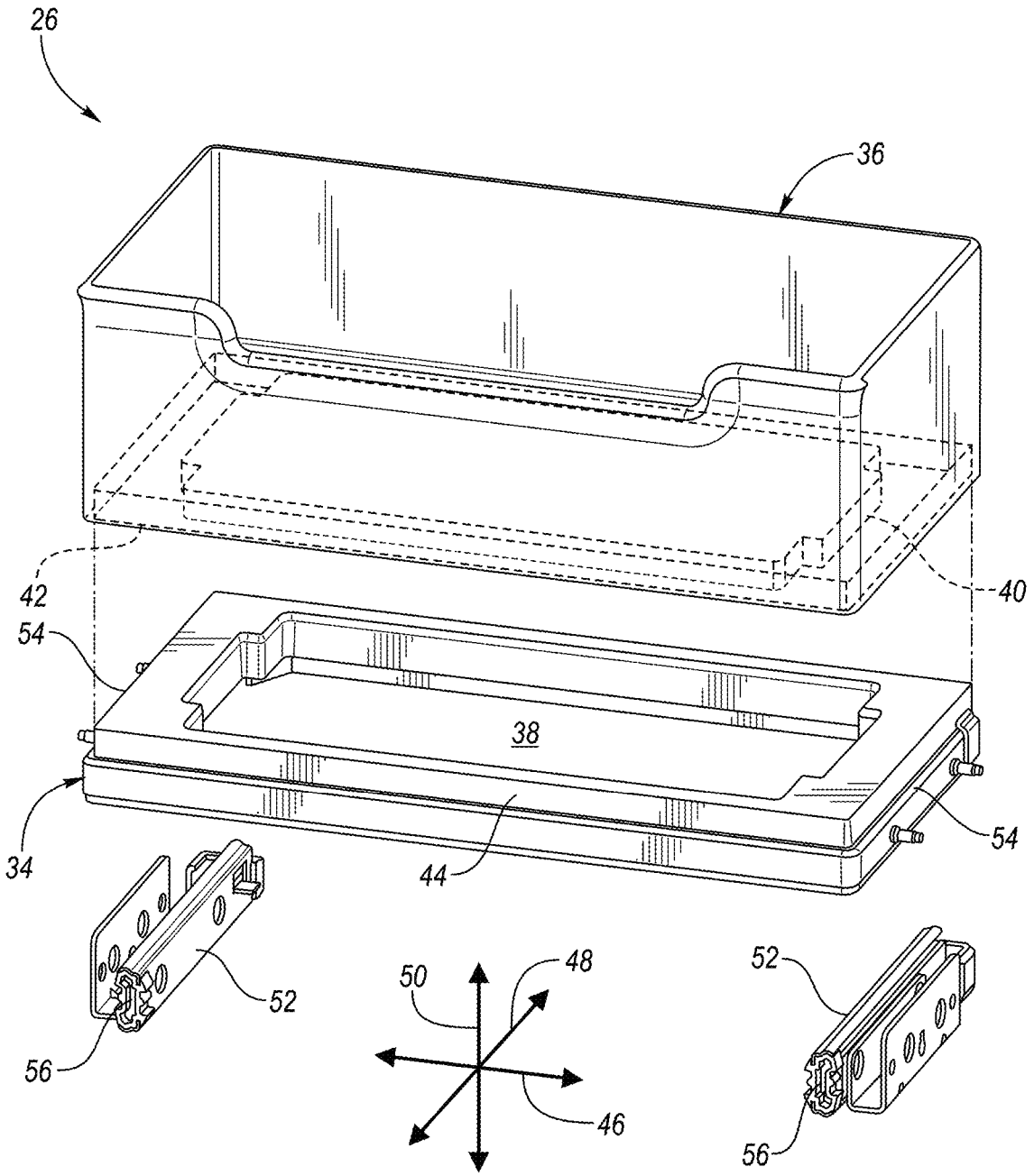
FIG. 3 is an exploded view of a bin storage system for the refrigerator appliance.
Figure 4:
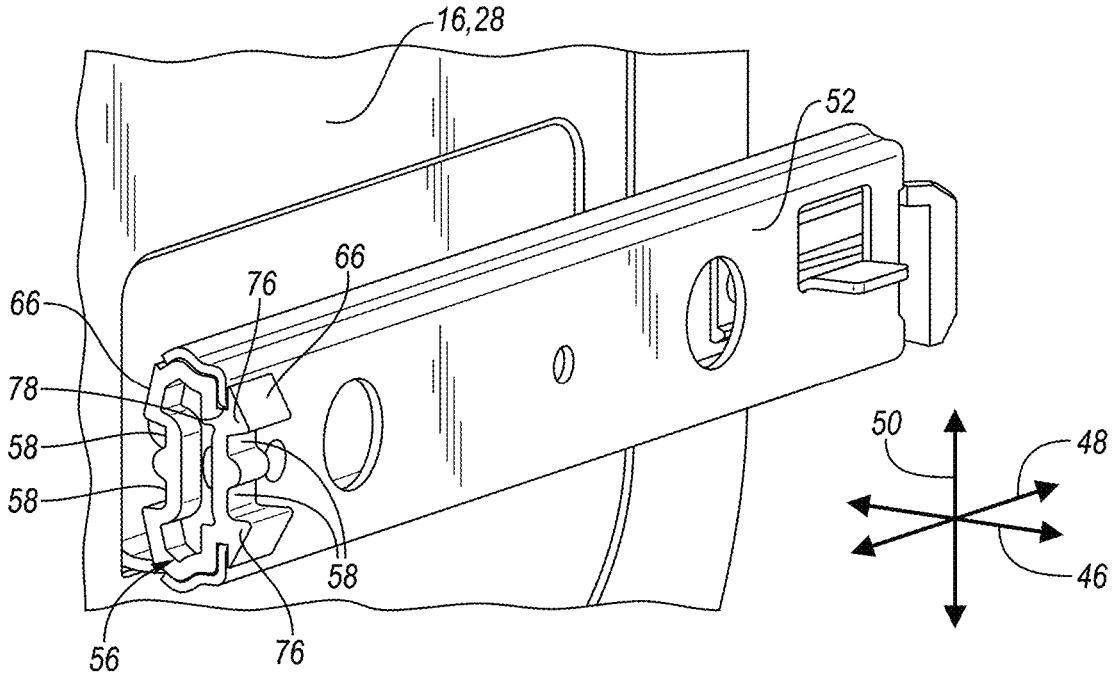
FIG. 4 is a front isometric view of a rail or linear guide that is utilized by the bin storage system.
Figure 6:
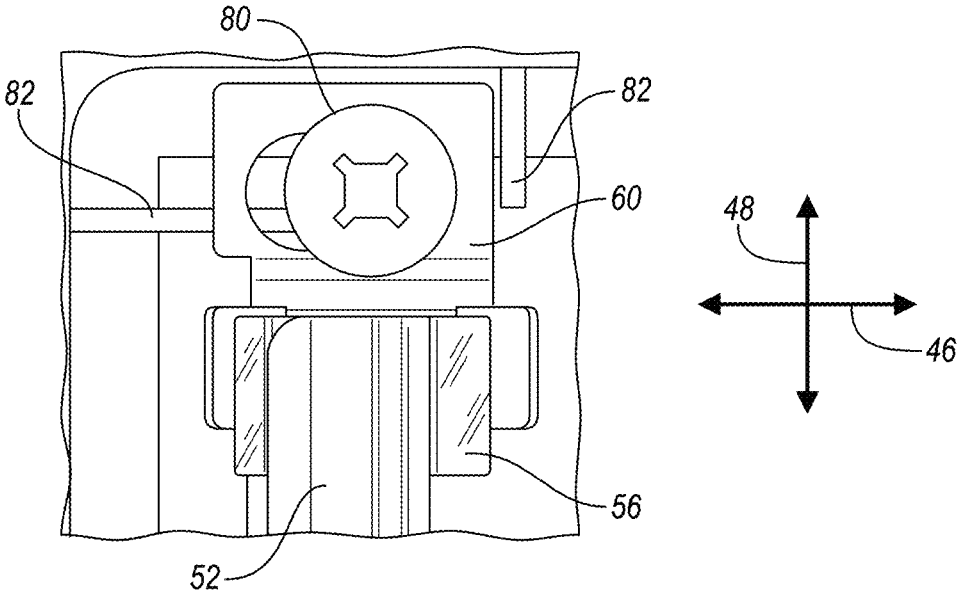
FIG. 6 is a lower view of the attachment configuration for the bin storage system.
Figure 5:
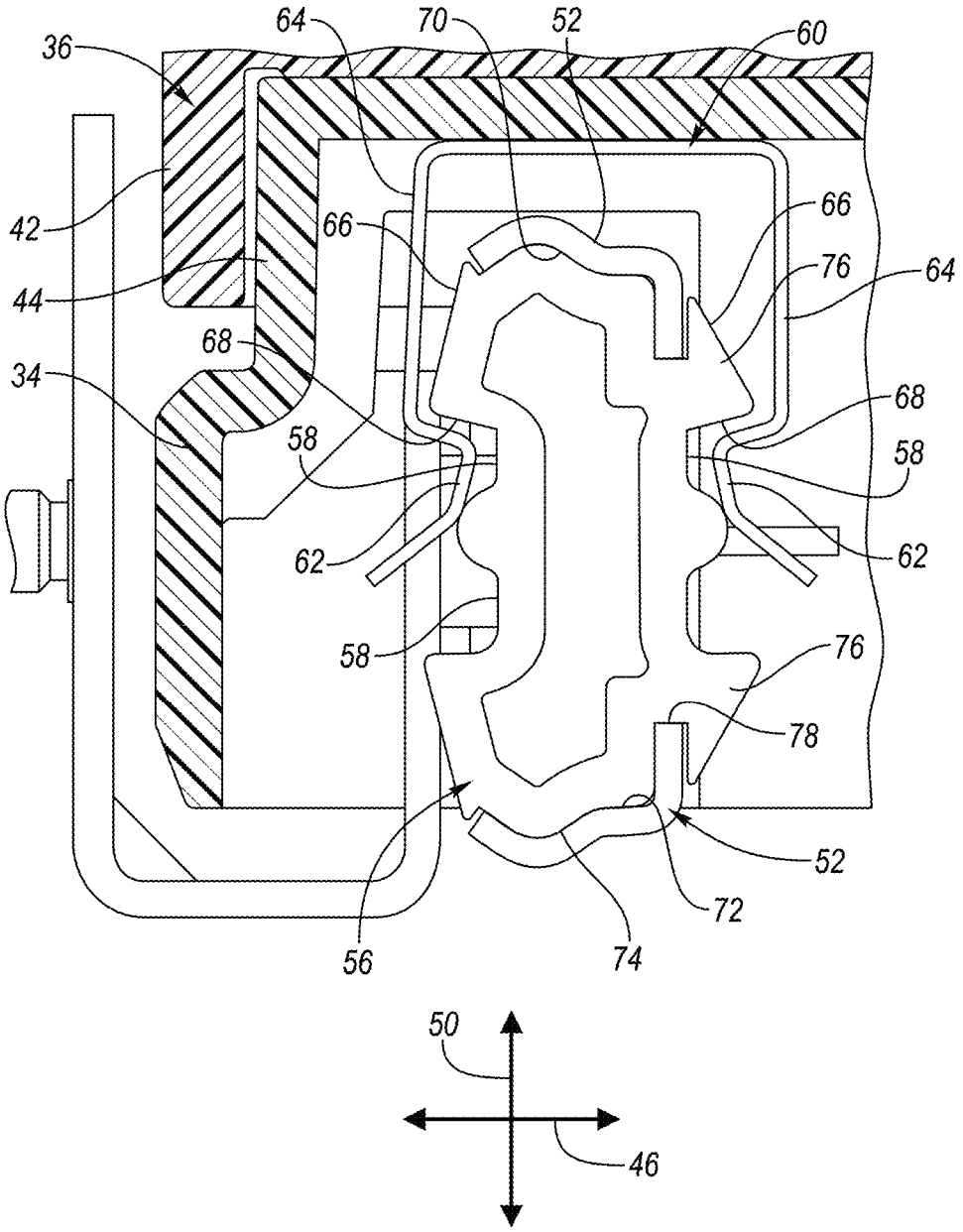
FIG. 5 is a partial cross-sectional view taken along line 5-5 in FIG. 2 illustrating an attachment configuration for the bin storage system.
Figure 7:
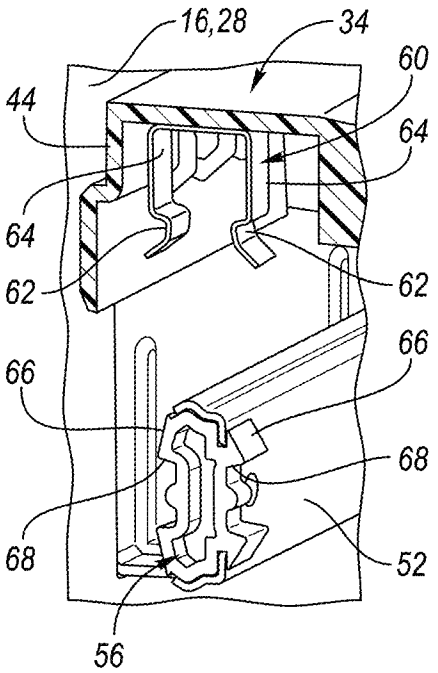
FIGS. 7-9 are partial cross-sectional views taken along line 5-5 in FIG. 2 illustrating the attachment of a frame of the bin storage system to the rail or linear guide.
Figure 7:
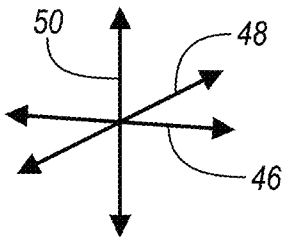
Figure 8:
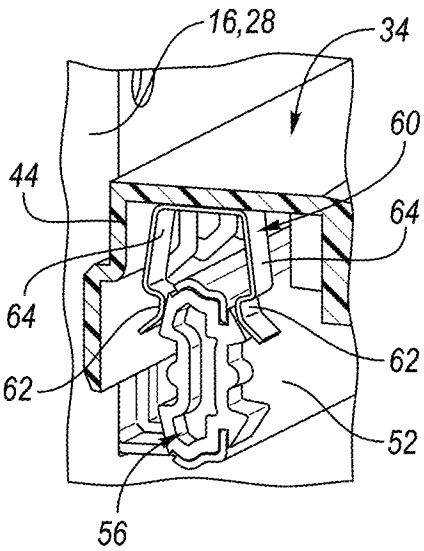
Figure 8:
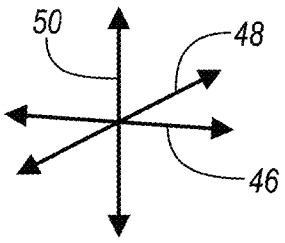
Figure 9:
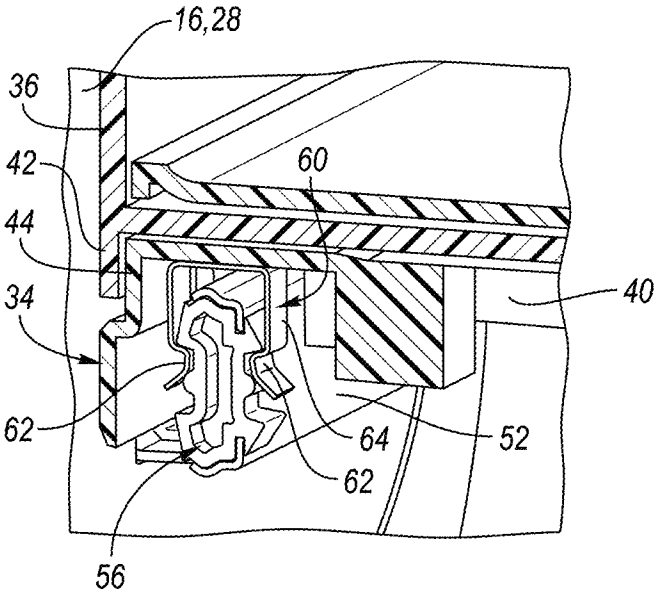
Figure 9:
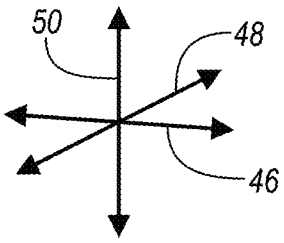

Referring to FIGS. 1 and 2, generally a refrigerator 10 of the French-Door Bottom Mount type is illustrated. However, it should be understood that this disclosure could apply to any type of refrigerator, such as a side-by-side, two-door bottom mount, or a top-mount type. As shown in FIGS. 1 and 2, the refrigerator 10 may have a first internal storage chamber or fresh food compartment 12 configured to refrigerate and not freeze consumables within the fresh food compartment 12, and a second internal storage chamber or a freezer compartment 14 configured to freeze consumables within the freezer compartment 14 during normal use. Each of the fresh food compartment 12 and the freezer compartment 14 may be referred to as refrigerated compartments. It is generally known that the freezer compartment 14 is typically kept at a temperature below the freezing point of water, and the fresh food compartment 12 is typically kept at a temperature above the freezing point of water and generally below a temperature of from about 35° F. to about 50° F., more typically below about 38° F.

The refrigerator 10 includes panels or walls 13 that form a housing or cabinet that defines the fresh food compartment 12 and the freezer compartment 14. The walls 13 may include a rear or back wall, a top wall, a bottom wall, and two side walls. The walls 13 may more specifically include exterior walls and an internal liner of the refrigerator 10. An insulating material, such as an insulating foam, may be disposed between the exterior walls and the internal liner. The internal liner may more specifically defined the fresh food compartment 12 and the freezer compartment 14.

One or more shelves may be secured to the walls 13 within the food compartment 12. The refrigerator 10 may have one or more doors 16, 18 that provide selective access to the interior volume of the refrigerator 10 where consumables may be stored. As shown, the fresh food compartment doors are designated 16, and the freezer door is designated 18. It may also be shown that the fresh food compartment 12 may only have one door 16. The doors 16, 18 may be movably secured to the cabinet or walls 13. For example, doors 16 may be rotatably secured to the cabinet or walls 13 by one or more hinges. As another example, door 18 may be slidably secured to the cabinet or walls 13 via rails.

The doors 16 may each include an exterior panel 20 and an interior panel 22 that is disposed on an internal side of the respective exterior panel 20 of each door 16. The interior panels 22 may be configured to face the fresh food 12 compartment when the doors 16 are in closed positions (See FIG. 1). The interior panel 22 may more specifically be a door liner. An insulating material, such as an insulating foam, may be disposed between the exterior panel 20 and interior panel 22 of each door 16 in order reduce the heat transfer from the ambient surroundings and increase the efficiency of the refrigerator.

The refrigerator 10 may also have a water inlet that is fastened to and in fluid communication with a household water supply of potable water. Typically, the household water supply connects to a municipal water source or a well. The water inlet may be fluidly engaged with one or more of a water filter, a water reservoir, and a refrigerator water supply line. The refrigerator water supply line may include one or more nozzles and one or more valves. The refrigerator water supply line may supply water to one or more water outlets; typically one outlet for water is in the dispensing area and another to an ice tray. The refrigerator 10 may also have a control board or controller that sends electrical signals to the one or more valves when prompted by a user that water is desired or if an ice making cycle is required.

Such a controller may be part of a larger control system and may be controlled by various other controllers throughout the refrigerator 10, and one or more other controllers can collectively be referred to as a "controller" that controls various functions of the refrigerator 10 in response to inputs or signals to control functions of the refrigerator 10. The controller may include a microprocessor or central processing unit (CPU) in communication with various types of computer readable storage devices or media. Computer readable storage devices or media may include volatile and nonvolatile storage in read-only memory (ROM), random-access memory (RAM), and keep-alive memory (KAM), for example. KAM is a persistent or non-volatile memory that may be used to store various operating variables while the CPU is powered down. Computer-readable storage devices or media may be implemented using any of a number of known memory devices such as PROMs (programmable read-only memory), EPROMs (electrically PROM), EEPROMs (electrically erasable PROM), flash memory, or any other electric, magnetic, optical, or combination memory devices capable of storing data, some of which represent executable instructions, used by the controller in controlling the refrigerator 10.

The doors 16 may also include storage systems or storage bins 24 that are operable to receive food items or containers for storage therein. The storage bins 24 may be secured to the interior panels 22 of each door 16. Alternatively, the storage bins 24 may be integrally formed within or defined by the interior panels 22 of each door 16. In yet another alternative, a portion of the storage bins 24 may be secured to the interior panels 22 of each door 16, while another portion of the storage bins 24 may be integrally formed within or defined by the interior panels 22 of each door 16. The storage bins 24 may include shelves (e.g., a lower surface upon, which a food item or container may rest upon) that extend from back and/or side surfaces of the interior panels 22 of each door 16. One or more of the storage systems or storage bins 24 may be drawers or pull-out bins 26. Such a drawer or pull-out bin 26 may be disposed on or secured to an interior side 28 of one of the doors 16 and may be configured to transition between a retracted or stowed position 30 and an advanced position or deployed position 32.

Referring to FIGS. 3-9, the pull-out bin 26 and associated elements are illustrated in further detail. The pull-out bin 26 includes a frame 34 and a bin or receptacle 36. The receptacle 36 is removably disposed on top of the frame 34 and is configured to receive items (e.g., food items or containers) for storage therein. The receptacle 36 is open along a topside of the receptacle 36. The frame 34 defines a keyed orifice 38. The receptacle 36 includes a keyed protrusion 40 extending downward therefrom that is configured to engage the keyed orifice 38. The receptacle 36 also includes a skirt 42 extending downward therefrom that is configured to engage a recessed region 44 of the frame 34. The recessed region 44 may be positioned along top side of the frame 34 and may extend around an outer perimeter or outer periphery of the frame 34. The skirt 42 may be positioned along a bottom side of the receptacle 36, extend along an outer periphery of the receptacle 36, and may extend around an outer perimeter or outer periphery of the keyed protrusion 40.

Engagement between the keyed protrusion 40 and keyed orifice 38 and engagement between the skirt 42 and the recessed region 44 may prevent or restrict lateral movement (e.g., side-to-side movement in direction 46) of the receptacle 36 relative to the frame 34. Engagement between the keyed protrusion 40 and the keyed orifice 38 and engagement between the skirt 42 and the recessed region 44 may prevent or restrict longitudinal movement (e.g., forward and rearward movement in direction 48) of the receptacle 36 relative to the frame 34. Vertical movement (e.g., up and down movement in direction 50) of the receptacle 36 relative to the frame 34, however, is not restricted by the engagement between the keyed protrusion 40 and keyed orifice 38 or engagement between the skirt 42 and the recessed region 44 so that the receptacle 36 may be removed from or placed onto the frame 34 along direction 50.

Linear guides or rails 52 are slidably secured to the interior side 28 of the door 16 and are disposed on opposing lateral sides of the pull-out bin 26. More specifically, the rails 52 are disposed opposing lateral sides 54 of the frame 34. The rails 52 movably secure the pull-out bin 26 to the interior side 28 of the door 16 such that the pull-out bin 26 is configured transition between the retracted or stowed position 30 and the advanced position or deployed position 32 via the rails 52. More specifically, the rails 52 may slidably secure the frame 34 to the interior side 28 of the door 16.

Caps 56 are disposed along ends of the rails 52. The caps 56 define recesses 58 extending laterally inward along sides of the caps 56 (e.g., inward along direction 46). Clips 60 extend downward from a bottom of the pull-out bin 26 and are secured to the pull-out bin 26. More specifically, the clips 60 may extend downward from a bottom of the frame 34 and may be secured to the frame 34. The clips 60 may have protrusions 62 extending laterally inward along sides of the clips 60 (e.g., inward along direction 46). The protrusions 62 are configured to extend into the recesses 58 and engage the caps 56 within the recesses 58 to secure the pull-out bin 26, or more specifically the frame 34, to the rails 52. Engagement between the clips 60 and the caps 56 (e.g., engagement between the protrusions 62 and the caps 56 within the recesses 58) may operate to restrict lateral movement of the pull-out bin 26, or more specifically the frame 34, in a direction extending between the rails 52 (e.g., direction 46).

The recesses 58 defined by each cap 56 may include one or more pairs of recess, where each pair of recess includes first and second recesses 58 extending laterally inward from an exterior of the corresponding cap 56 (e.g., inward along direction 46) and toward each other. Each clip 60 may include first and second protrusions 62 extending laterally inward (e.g., inward along direction 46) and toward each other. The first and second protrusions 62 are configured to engage and apply forces to the caps 56 in opposing directions (e.g., toward each other along direction 46) within corresponding first and recesses 58, which is operable to prevent lateral movement (e.g., movement along direction 46) between the clips 60 and caps 56, and is ultimately operable to prevent lateral movement between the pull-out bin 26, or more specifically the frame 34, and the rails 52. The clips 60 may further comprise biasing elements 64 and each protrusion 62 may extend from one of the biasing elements 64. The biasing elements 64 are operable to bias the protrusions 62 inward and into the recesses 58, and to facilitate the protrusions 62 engaging and applying forces to the caps 56. The biasing elements 64 may be springs (e.g., leaf springs).

The caps 56 include ramped surfaces 66 disposed above the recesses 58. The ramped surfaces 66 are configured drive the protrusions 62 laterally outward (e.g., outward along direction 46) during installation of the clips 60 onto the caps 56 (e.g., FIG. 8). The biasing elements 64 are configured to drive the protrusions 62 laterally inward (e.g., inward along direction 46) and into the recesses 58 upon completion of installation of the clips 60 onto the caps 56 (e.g., FIG. 9). The caps 56 also include stop surfaces 68 disposed below the ramped surfaces 66. The stop surfaces 68 are configured to engage tops of the protrusions 62 upon completion of installation of the clips 60 onto the caps 56 to inhibit removal of the clips 60 (e.g., the stop surfaces restrict vertical movement of the clips 60 along direction 50 once installed onto the caps 56.

Ends of the rails 52 have interior profiles 70 defining cavities 72. Each cap 56 is disposed within one of the cavities 72. The caps 56 have exterior profiles 74 engaging the interior profiles 70 within the corresponding cavities 72 to restriction relative rotational movement between the rails 52 and the caps 56. The caps 56 may further include snapping features 76 that protrude through openings 78 defined by the rails 52. The snapping features 76 may be operable for securing the caps 56 to the rails 52.

The clips 60 may be secured to the pull-out bin 26, or more specifically to the frame 34, via fasteners 80. The pull-out bin 26, or more specifically to the frame 34 may include retaining features, such as bosses 82, that engage edges of the clips 60 to restrict movement of the clips 60 relative to the pull-out bin 26, or more specifically relative to the frame 34. More specifically, the bosses 82 may engage the clips 60 to restrict lateral movement of the clips 60 (e.g., movement in direction 46) and forward and rearward movement of the clips 60 (e.g., movement in direction 48) relative to the pull-out bin 26, or more specifically relative to the frame 34.

It should be understood that the designations of first, second, third, fourth, etc. for any component, state, or condition described herein may be rearranged in the claims so that they are in chronological order with respect to the claims. Furthermore, it should be understood that any component, state, or condition described herein that does not have a numerical designation may be given a designation of first, second, third, fourth, etc. in the claims if one or more of the specific component, state, or condition are claimed.

The words used in the specification are words of description rather than limitation, and it is understood that various changes may be made without departing from the spirit and scope of the disclosure. As previously described, the features of various embodiments may be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. As such, embodiments described as less desirable than other embodiments or prior art implementations with respect to one or more characteristics are not outside the scope of the disclosure and may be desirable for particular applications.

What is claimed is:

1. A refrigerator comprising:

a cabinet defining at least one refrigerated compartment;

a door movably secured to the cabinet;

a pull-out bin secured to an interior side of the door and configured to transition between retracted and advanced positions, the pull-out bin comprising a frame and a receptacle, wherein the receptacle is removably disposed on top of the frame and is configured to receive items for storage therein;

rails slidably secured to the interior side of the door and disposed on opposing lateral sides of the pull-out bin, wherein the pull-out bin is configured to transition between the retracted and advanced positions via the rails;

caps disposed along ends of the rails, each cap defining first and second recesses extending laterally inward and toward each other along sides of the caps; and clips extending downward from a bottom of the frame, each clip having first and second protrusions extending laterally inward and toward each other along sides of the clips, wherein the protrusions extend into the recesses and engage the caps within the recesses to secure the frame to the rails and restrict lateral movement of the frame in a direction extending between the rails.

2. The refrigerator of claim 1, wherein the clips further comprise biasing elements configured to bias the protrusions inward and into the recesses.

3. The refrigerator of claim 2, wherein the caps include ramped surfaces disposed above the recesses, the ramped surfaces are configured to drive the protrusions laterally outward during installation of the clips onto the caps, and the biasing elements are configured to drive the protrusions laterally inward and into the recesses upon completion of installation of the clips onto the caps.

4. The refrigerator of claim 3, wherein the caps include stop surfaces disposed below the ramped surfaces, and the stop surfaces are configured to engage tops of the protrusions upon completion of installation of the clips onto the caps to inhibit removal of the clips.

5. The refrigerator of claim 1, wherein ends of the rails have interior profiles defining cavities, each cap is disposed within one of the cavities, and the caps have exterior profiles engaging the interior profiles within the corresponding cavities to restrict relative rotational movement between the rails and the caps.

6. A refrigerator comprising:

a cabinet defining a refrigerated compartment;

a door secured to the cabinet;

a drawer disposed on the door and operable to receive items for storage therein;

a rail movably securing the drawer to the door;

a cap disposed along an end of the rail and defining at least one recess extending laterally inward from an exterior of the cap; and a clip extending downward from a bottom of the drawer, wherein the clip comprises at least one biasing element and at least one laterally extending protrusion extending from the at least one biasing element, wherein the at least one laterally extending protrusion extends into the at least one recess and engages the cap within the at least one recess to secure the drawer to the rail and restrict movement of the drawer relative to the rail, wherein the cap includes at least one ramped surface disposed above the at least one recess, the at least one ramped surface is configured to drive the at least one laterally extending protrusion outward during installation of the clip onto the cap, and the at least one biasing element is configured to drive the at least one laterally extending protrusion inward and into the at least one recess upon completion of installation of the clip onto the cap.

7. The refrigerator of claim 6, wherein the cap includes at least one stop surface disposed below the at least one ramped surface, and the at least one stop surface is configured to engage a top of the at least one laterally extending protrusion upon completion of installation of the clip onto the cap to inhibit removal of the clip.

8. The refrigerator of claim 6, wherein the at least one recess defined by the cap includes first and second recesses extending laterally inward and toward each other.

9. The refrigerator of claim 8, wherein the at least one laterally extending protrusion includes first and second protrusions extending laterally inward and toward each other.

10. The refrigerator of claim 6, wherein an end of the rail has an interior profile defining a cavity, the cap is disposed within the cavity, and the cap has an exterior profile engaging the interior profile within the cavity to restrict relative rotational movement between the rail and the cap.

11. The refrigerator of claim 6, wherein the drawer includes a frame and a bin removably disposed on top of the frame.

12. The refrigerator of claim 11, wherein the rail and the clip are secured to the frame.

13. A storage system for a refrigerator comprising:

a drawer having a frame and a bin removably disposed on top of the frame;

a rail movably secured to the frame such that the drawer is operable to transition between deployed and stowed positions;

a cap disposed along an end of the rail and defining a recess extending laterally inward therefrom; and a clip extending downward from the frame and comprising a laterally extending protrusion, wherein the laterally extending protrusion extends into the recess and engages the cap within the recess to secure the frame to the rail and restrict lateral movement of the frame relative to the rail, wherein the clip further comprises a biasing element configured to bias the protrusion inward and into the recess, the cap includes a ramped surface disposed above the recess, the ramped surface is configured to drive the laterally extending protrusion outward during installation of the clip onto the cap, and the biasing element is configured to drive the laterally extending protrusion inward and into the recess upon completion of installation of the clip onto the cap.

14. The storage system of claim 13, wherein the cap includes a stop surface disposed below the ramped surface, and the stop surface is configured to engage a top of the laterally extending protrusion upon completion of installation of the clip onto the cap to inhibit removal of the clip.

15. The storage system of claim 13, wherein an end of the rail has an interior profile defining a cavity, the cap is disposed within the cavity, and the cap has an exterior profile engaging the interior profile within the cavity to restrict relative rotational movement between the rail and the cap.

16. The refrigerator of claim 1, wherein the clips are secured to the frame via fasteners.

17. The refrigerator of claim 1, wherein the frame defines a keyed orifice and the receptacle includes a keyed protrusion operable to engage the keyed orifice.

18. The refrigerator of claim 6, wherein the clips are secured to the drawer via fasteners.

19. The storage system of claim 13, wherein the clips are secured to the frame via fasteners.

20. The storage system of claim 13, wherein the frame defines a keyed orifice and the bin includes a keyed protrusion operable to engage the keyed orifice.

* * * * *